United States Patent [19]

Jatkar et al.

[11] Patent Number: 4,557,893

[45] Date of Patent: Dec. 10, 1985

[54] PROCESS FOR PRODUCING COMPOSITE MATERIAL BY MILLING THE METAL TO 50% SATURATION HARDNESS THEN CO-MILLING WITH THE HARD PHASE

[75] Inventors: Arun D. Jatkar, Monroe; Alfred J. Varall, Jr., Middletown; Robert D. Schelleng, Suffern, all of N.Y.

[73] Assignee: INCO Selective Surfaces, Inc., Wyckoff, N.J.

[21] Appl. No.: 507,837

[22] Filed: Jun. 24, 1983

[51] Int. Cl.[4] ..... B22F 1/00

[52] U.S. Cl. ..... 419/12; 419/32; 419/13; 419/14; 419/17; 419/19; 419/33; 419/35

[58] Field of Search ..... 75/232, 236, 239, 240, 75/244; 419/10, 12, 13, 14, 15, 17, 18, 19, 32, 33, 35

[56] References Cited

U.S. PATENT DOCUMENTS

| | | | |
|---|---|---|---|
| 3,037,857 | 6/1962 | Conant et al. | 419/12 X |
| 3,591,362 | 7/1971 | Benjamin | 419/31 X |
| 3,607,254 | 9/1971 | Hammond | 419/32 X |
| 3,859,056 | 1/1975 | Hara et al. | 419/15 X |
| 3,865,586 | 2/1975 | Volin et al. | 419/32 X |
| 3,890,166 | 6/1975 | Kondis | 419/33 X |
| 4,060,414 | 11/1977 | Kaufman | 419/35 X |
| 4,066,449 | 1/1978 | Havel | 419/32 |
| 4,104,062 | 8/1978 | Weaver | 75/238 |
| 4,257,809 | 3/1981 | Burden | 419/32 X |
| 4,320,204 | 3/1982 | Weaver | 75/238 X |

FOREIGN PATENT DOCUMENTS

| | | | |
|---|---|---|---|
| 93212 | 7/1975 | Japan | 419/13 |
| 102508 | 8/1975 | Japan | 419/12 |
| 91952 | 7/1980 | Japan | 419/12 |
| 692696 | 10/1979 | U.S.S.R. | 419/32 |

OTHER PUBLICATIONS

Goetzel, C. G., *Treatise on Powder Metallurgy*, vol. I, Interscience Publishers, Inc., N.Y. (1949), pp. 251–253.

Lenel, Fritz V., *Powder Metallurgy Principles and Applications*, Metal Powder Industries Federation, Princeton, N.J. (1980), pp. 387–388, 396, 508–520.

The Condensed Chemical Dictionary, Ninth Ed., 1971, Van Nostrand Reinhold Co., New York, p. 779.

*Primary Examiner*—Edward A. Miller

*Assistant Examiner*—Matthew A. Thexton

*Attorney, Agent, or Firm*—Francis J. Mulligan, Jr.; Raymond J. Kenny

[57] ABSTRACT

A process for producing composite materials which comprises subjecting particles of a malleable matrix material, i.e., a metal or alloy or the components of a matrix alloy and particles of a reinforcing material such as a carbide or an oxide or an intermetallic to energetic mechanical milling under circumstances to insure the pulverulent nature of the mill charge so as to enfold matrix material around each of said reinforcing particles to provide a bond between the matrix material and the surface of the reinforcing particle. The process is exemplified by the use of aluminum alloy as the matrix material and silicon carbide as the reinforcing particles. Reinforcing particles are present in an amount of about 0.2 to about 30 volume percent of total matrix and reinforcing particles. The invention is also directed to the product of the process.

5 Claims, No Drawings

PROCESS FOR PRODUCING COMPOSITE MATERIAL BY MILLING THE METAL TO 50% SATURATION HARDNESS THEN CO-MILLING WITH THE HARD PHASE

TECHNICAL FIELD

This invention is concerned with the manufacture of a composite structure having hard particles distributed in a metallic matrix.

HISTORY OF THE ART AND PROBLEM

For a very long time it has been customary to combine materials when any given available material does not have properties or characteristics necessary to perform a specific, desired function. In recent times such combinations of materials have become known as "composites". Examples of composites which come to mind include graphite-reinforced resins used in fishing rods, bicycle frames, etc., glass-reinforced resins used in boat hulls and the like and wood-FORMICA ™ laminates used in furniture, kitchen surfaces, etc. Other composites, not immediately recognizable as such include many aircraft and autobody components and natural composites such as tree trunks, animal bones, etc. Each composite is characterized by having mechanical, physical or chemical characteristics such that at least one characteristic is reflective of one material of the composite and at least one characteristic reflective of another material of the composite. For example, if one considers a glass reinforced boat hull, the strength of the composite is reflective of the tensile strength and elastic modulus of the glass fiber, whereas the resin contributes to light weight and water resistance.

Thus, for purposes of this specification and claims, the term "composite" is used in the sense of a material made of two or more components having at least one characteristic reflective of each component. In this sense, a composite of the kind described and claimed in this application differs from a dispersion-hardened alloy or metal. Like a composite, a dispersion hardened metal has a hard phase distributed in a metal matrix. But unlike a composite, in a dispersion hardened metal, the hard phase generally comprises particles of such minute size of such a relatively small quantity that generally the characteristics of the hard phase merge into and enhance the characteristics of the matrix but are not themselves significantly reflected in the final product.

Prior to the present invention, it has been known to make composites of a matrix metal and another phase. Taking, for example, aluminum or an aluminum alloy as the matrix and silicon carbide as a hard phase, composites have been made using both particulates and fibers or whiskers of silicon carbide. Briefly, these composites have been made by gently (or non-energetically) mixing powder of the matrix material with about 5 to 30 volume percent of silicon carbide in any one of the above forms, e.g., powders, fibers or whiskers. The mixed powder was then compacted to a reasonable density and then hot pressed under a controlled, protective atmosphere in a graphite-lined steel die to provide a dense body. In order to produce a bond between the matrix and the hard phase when making silicon carbide composites by this method, it is necessary to vacuum hot press at a temperature at which part of the metallic matrix is molten. Using aluminum alloy as the matrix, the prior art workers have found that the heating temperature must exceed the solidus temperature of the alloy. If pure aluminum were to be used as the matrix, at least an incipient melting must occur.

The use of hot pressing temperatures at which a liquid phase exists is required in the prior method to provide bonding between the matrix and the reinforcing material. In a so-called composite product, if bonding of some metallurigcal, chemical or physical nature does not exist at all or is relatively weak, the so-called composite will not exhibit the desired combination of properties. Going back to the boat hull illustration, if glass and resin do not mutually wet and bond, the hull will rapidly delaminate or fall apart because the glass fibers and resin will react separately and independently to forces acting on the boat hull. The same overall effect occurs if a metal matrix and a reinforcing phase are not properly bonded together. In some cases, however, the technique of obtaining bonding between the metal matrix and the reinforcing phase via liquid phase processing may produce deleterious side effects. Specifically, it is difficult to control temperature in the sometimes narrow range between the liquidus and solidus temperatures to avoid overheating. Accidental overheating to a point where liquid phase predominates may result in segregation of the reinforcing phase when, as usual the reinforcing phase and the matrix do not match in density. More importantly, when accidental overheating occurs it is difficult to maintain the mechanical integrity and geometrical configuration of the semi-finished composite body. The smaller the difference between the solidus and liquidus temperatures (miniscule to nonexistent with a pure matrix metal) the more severe is the damage from accidental overheating and the higher the probability that such an overheating will occur. Further, even if the temperature is properly controlled so as to maintain the presumably good dispersion of hard reinforcing phase in matrix that is produced by initial mixing, use of high pressing temperatures at or near the solidus results in undesirable grain growth in the matrix. Still further, if the matrix is a dispersion hardened alloy, such high temperatures producing a liquid component in the heat treated composite will destroy the randomness of the dispersion hardening phase in the volumes of liquid phase. Additional practical difficulties with super solidus heat treatment which increase as scale of size of heat treated structures increases are means of containment and means of applying heat. A large structure of metal receiving super solidus heat treatment will have to be totally contained or have complete bottom, side and end support to avoid self distortion. In effect, the hot pressing of a component in a configuration close to final must be carried out in a can or a mold or die so constructed as to avoid expressing molten metal from the reinforcing material. Similarly, a large billet must be treated internally with close control. Conventional heating, where the $\Delta T$ between heat source and object being heated causes heat transfer to the object being heated would, unless very closely controlled, result in a billet with a totally molten skin prior to the interior heated above the solidus temperature.

In light of the foregoing, it is clearly desirable to provide a process whereby a reinforcing phase can be bonded to a matrix metal without heating to a temperature above the solidus of the matrix metal and thereby provide an effective composite between the reinforcing phase and the matrix. Provision of such a process is an object of the present invention.

DESCRIPTION OF THE INVENTION

The present invention contemplates a process for producing a composite material in the sense as set forth hereinbefore which comprises subjecting particles of a malleable matrix metallic material, i.e., a metal or an alloy or the components of an alloy and particles of a reinforcing material such as a hard carbide, oxide, boride, carbo-boride, nitride or a hard intermetallic compound advantageously in an amount of about 0.2 to about 30 percent by volume of total matrix and hard material to energetic mechanical milling, so as to enfold metallic matrix material around each of the reinforcing particles while maintaining the charge being subjected to energetic mechanical milling in a pulverulent (powdery) state and thereby provide, a strong bond between the matrix material and the surface of the reinforcing particle. After energetic mechanical milling is completed, the resultant powder is hot pressed or otherwise treated by sintering in a manner normal to the known powder metallurgical techniques for the matrix material. The compressed and treated powder compact can then be mechanically worked to increase density and provide engineering shapes for use in industry.

The present invention also contemplates the product of such energetic mechanical milling, i.e., a powder product in which reinforcing particulate is enfolded in and bonded to metal matrix powder.

The malleable metal matrix can be any metal or allow which is malleable or workable at room temperature (25° C.) or at a slightly elevated temperature prevailing in a horizontal rotary ball mill or an attritor. Examples of useful structural metals suitable as matrix materials include iron, nickel, titanium, molybdenum, zirconium, copper and aluminum and alloys of these metals including carbon steel, nickel-containing and nickel-free stainless steels, MONEL™ nickel-copper alloys, nickel-chromium-base high temperature alloys with or without cobalt, brass, bronze, aluminum bronze, cupronickel and various aluminum alloys in the 1000, 2000, 3000, 4000, 5000, 6000, 7000 and 8000 series as defined by the Aluminum Association. The metal of the matrix must be provided as a powder, for example, an atomized powder of the particular metal or alloy desired. Alternatively mixtures of elemental powders such as nickel powder and copper powder can be used to provide a matrix alloy (for example, in proportions to provide a cupronickel matrix). Of course, the mixtures need not be of pure elements, since it may be advantageous to include an element as a master alloy powder. For example, magnesium might be used as a master alloy containing magnesium and nickel in order to avoid handling elemental magnesium powder. Another example of the same kind is to include lithium as a master alloy powder of say, 10% lithium in aluminum. For purposes of this specification and claims the term "hard", as applied to particles which may form the reinforcing phase of the resultant composite shall generally imply (1) a scratch hardness in excess of 8 on Ridgway's Extension of MOHS' Scale of Hardness, and (2) an essentially non-malleable character. It is possible with some relatively soft matrices (e.g., copper or aluminum) that useful composites can be made with reinforcing particles that are somewhat softer than what is generally considered for the purposes of this invention, for example, graphite particles. It is believed that the process of the present invention will also be applicable to those special cases but, for purposes of description, the general case of "hard" particles will be treated. Hard particles useful in the process of the invention include non-filamentary particles of silicon carbide, aluminum oxide, zirconia, garnet, aluminum silicates including those silicates modified with fluoride and hydroxide ions (e.g., topaz), boron carbide, simple or mixed carbides, borides, carboborides and carbo-nitrides of tantalum, tungsten, zirconium, hafnium and titanium, and intermetallics such as $Ni_3Al$. In particular, because of relatively low density and high modulus, the present invention is especially concerned with a process for producing composites having an aluminum alloy as the matrix and silicon carbide or boron carbide as the dispersed reinforcing particulate. While it is not essential to the operation of the process of the present invention, it is advantageous from the standpoint of composite properties and characteristics to use at least about 10% by volume of hard particles (based upon total matrix and hard particles) in the manufacture of composites by the process of the present invention. It is also important to note that, while in most instances, a single type of reinforcing particle will be used in the amount stated in composites made by the process of the present invention, it may be advantageous to employ more than one type of reinforcing particle. In the same vein, matrices can be single phase, duplex or contain dispersed phases provided by in situ precipitation of such phases or by inclusion of micro particulate during or prior to the energetic mechanical milling step of the process of the present invention.

The term "energetic mechanical milling" in the context of the present specification and claims means milling by mechanical means with an energy intensity level comparable to that in mechanical alloying, as described and defined in U.S. Pat. No. 3,591,362 to Benjamin. The energetic mechanical milling step of the present process can be carried out in a Szegvari attritor (vertical stirred ball mill) containing steel balls or in a horizontal rotary ball mill under conditions such that the welding of matrix particles into large agglomerates is minimized. Thus, as in the process of Benjamin, processing aids are used to prevent excessive metal welding. However, unlike the Benjamin process, milling in the present process need only be carried out for that time necessary to produce a complete dispersion and coating of hard particles in the matrix material. It is not necessary or useful to mill to saturation hardness unless mechanical alloying is being accomplished simultaneously with the process of the present invention. In the case of light matrix metals such as aluminum and conventional aluminum alloys containing one or more of the elements copper, nickel, magnesium, iron, lithium, which are of particular concern in the present invention, the energetic milling (or, for convenience "mechanical alloying") with the hard material must be done in a special way. Specifically, if a charge of light metal powder, processing aid (e.g., stearic acid) and hard reinforcing material, e.g., silicon carbide particulate, is subjected to mechanical alloying, as disclosed by Benjamin, no significant yield of useful product will result. The charge will rapidly ball up and clog the mill. As an example, of this, a charge of aluminum, copper and magnesium powder to provide an Al-4Cu-1.5 Mg alloy matrix along with 1.5% stearic acid (based upon metal) and 5% by volume of silicon carbide was subjected to mechanical alloying. In a short time, the powder packed and welded to the side wall of the attritor vessel and no useful product was obtained. When light metals (and perhaps other readily pressure welded metals) are employed in the process of the present invention, it is necessary to first mechanically alloy in the absence of hard material for a time sufficient to achieve 50% or even 75% of saturation hardness of the light metal charge, then add the hard material to the charge and complete the mechanical alloying operation. Thus it has been found that an adequate dispersion of silicon carbide particulate in a mechanically alloyed aluminum alloy matrix can be produced in about ¼ to about three hours in an attritor, the matrix powder having previously been mechanically alloyed at least about 8 hours and up to about 12 hours.

After dispersion is completed, the resultant powder is compacted alone or mixed with additional matrix material under conditions normal for production of powder metallurgical bodies from the matrix metal. Thereafter, the resultant composite compact is vacuum hot pressed or otherwise treated under conditions normal for the matrix metal, the conditions being such that no significant melting of the matrix metal occurs. With an aluminum alloy/silicon carbide composite after pressing into a can, hot pressing can be accomplished in vacuum at about 510° C. followed by extrusion.

Those skilled in the art will appreciate that other time/temperature combinations can be used and that other variations in pressing and sintering can be employed. For example, instead of simple pressing, the composite powder can be hot pressed, for example, isostatically hot pressed and auxiliary sintering times or temperatures can be reduced. Alternatively, instead of pressing, a powder metallurgical shape made with composite powder can be slip cast using a liquid medium inert to the matrix metal and to the reinforcement material. In general, any technique applicable to the art of powder metallurgy which does not involve liquefying (melting) or partially liquefying the matrix metal can be used.

After hot pressing or otherwise heat processing is complete, a composite of substantially final form and size made according to the process of the present invention can be densified by pressing hot or cold, by coining, by sizing or by any other working operation, which limits deformation of the sintered object to that amount of deformation allowed by the specified tolerances for the final object. In addition and even more importantly, the sintered object can be in the form of a billet, slab or other shape adapted to be worked into structural shapes, e.g., rod, bar, wire, tube, sheet and the like. Conventional means appropriate to the metal of the matrix and the character of the required structural shape can be used. These conventional means, operated hot or cold, include forging, rolling, extrusion, drawing and similar working processes. For the illustrative composite, i.e., an aluminum alloy matrix having silicon carbide particles dispersed therein, small sintered billets have been reduced to 1.9 cm by means of extrusion at a 23 to 1 ratio operated at a temperature of about 510° C. The dispersion (distribution) of the reinforcing material in composite products produced by this process is far superior to the dispersion produced by prior methods of producing such composites.

BEST MODE FOR CARRYING OUT THE INVENTION

Silicon carbide-aluminum alloy matrix composites were made in the following manner. Powder metallic ingredients, in grams, were weighed out to provide a 3288.6 aluminum, 52.2 magnesium, 139.2 copper blend to which was added 48.8 parts by weight of stearic acid. The metal powder and stearic acid were fed into a stirred ball mill known as a Szegvari attritor size 4S containing a charge of 69 kilograms of 52100 steel balls each about 7.54 mm in diameter. The powder was then subjected to mechanical alloying for 12 hours in a nitrogen atmosphere. The attritor was then drained and the mechanically alloyed powder stabilized (i.e., rendered non-pyrophoric) in an 8% oxygen balance nitrogen atmosphere for about one hour. This stabilized powder was then mixed with silicon carbide grit having an average particle size of about 3 μm in amounts of 5, 10, 15, 20, 25 and 30 volume percent. The silicon carbide grit grade SL1 obtained from Carborundum Corporation had an analysis as set in Table 1.

TABLE I

| Material | % by Wt. |
|---|---|
| Free Silicon | 2.7 |
| Iron | 0.061 |
| Aluminum | 0.20 |
| Free Carbon | 2.00 |
| Oxygen | 0.26 |
| Total Carbon | 30.30 |
| Total Silicon | 68.90 |

The samples to which silicon carbide grit was added were processed further in the stirred ball mill mentioned hereinbefore for two hours to enfold grit particles in the matrix metal under conditions such that a strong particle-matrix bond can be formed.

After processing in the stirred ball mill is complete, the powder was drained and exposed to an 8% oxygen/nitrogen atmosphere for about an hour to stabilize the powder. The samples were then canned and the canned product was evacuated while heating at about 510° C. The cans were then sealed and compacted at a temperature of about 510° C. The cans were removed from hot compacted canned product by machining. Following this, the hot compacted products were extruded at about 510° C. using an extrusion ratio of about 23:1 to form bars about 19 mm in diameter.

Average mechanical characteristics of extruded product at room temperature are set forth in Table II, along with heat treatment conditions.

TABLE II

| SiC Vol. % | Heat Treatment | Hardness (D.P.H.) | Tensile Properties at Room Temp. Y.S. (MPa) | UTS (MPa) | El. (%) | R.A. (%) | Modulus (GPa) |
|---|---|---|---|---|---|---|---|
| 0 | A | 202 | ND | ND | ND | ND | ND |
| | B | 217 | 556 | 601 | 13.0 | 18.3 | 72.0 |
| 15 | A | 226 | ND | ND | ND | ND | ND |
| | B | 255 | 581 | 631 | 2.5 | 3.0 | 96.0 |
| 30 | A | 249 | ND | ND | ND | ND | ND |
| | B | 293 | ND | ND | ND | ND | ND |

NOTE:
A = 510° C./1 hr/Water Quench
B = A + natural aging at room temperature for 360 hours.

Results of tensile testing at 150° C. are set forth in Table III with respect to composites containing 5, 10 and 15 volume percent silicon carbide and with respect to the unreinforced matrix metal.

TABLE III

| SiC Content (Vol. %) | Y.S. 0.2% Offset (MPa) | UTS (MPa) | El. (%) | R.A. (%) | Elastic Modulus (GPa) |
|---|---|---|---|---|---|
| 0 | 552 | 552 | 13.0 | 23.0 | 63.4 |
| | 529 | 538 | 4.0 | 11.0 | N.D. |

TABLE III-continued

| SiC Content (Vol. %) | Y.S. 0.2% Offset (MPa) | UTS (MPa) | El. (%) | R.A. (%) | Elastic Modulus (GPa) |
|---|---|---|---|---|---|
| | 512 | 534 | 13.0 | 24.0 | 77.2 |
| 5 | 532 | 545 | 4.0 | 4.0 | 77.2 |
| | 515 | 533 | 5.0 | 5.0 | 81.4 |
| | 513 | 524 | 5.0 | 2.5 | 75.2 |
| | 502 | 526 | 4.0 | 3.0 | 74.5 |
| 10 | 565 | 585 | 1.0 | 2.5 | 84.8 |
| | 565 | 583 | 4.0 | 3.5 | 95.1 |
| | 543 | 549 | 3.0 | 2.5 | 85.5 |
| | 533 | 540 | 3.0 | 5.5 | 89.9 |
| 15 | 542 | 607 | 3.0 | 4.5 | 84.1 |
| | 566 | 609 | 5.0 | 6.0 | N.D. |

Further results of tensile testing at 232° C. and 315° C. of material extruded at 510° C. are set forth in Table IV.

TABLE IV

| SiC Content (Vol. %) | Y.S. 0.2% Offset (MPa) | UTS (MPa) | El. (%) | R.A. (%) | Elastic Modulus (GPa) |
|---|---|---|---|---|---|
| | | Temperature 232° C. | | | |
| 0 | 152 | 207 | 42.0 | 84.5 | 41.4 |
| | 150 | 219 | 32.0 | 79.5 | 47.9 |
| 5 | 172 | 235 | 31.0 | 42.5 | 64.8 |
| | 165 | 222 | 32.0 | 48.5 | 57.9 |
| | 161 | 217 | 26.0 | 44.5 | 68.3 |
| | 163 | 221 | 20.0 | 30.5 | 62.1 |
| 15 | 174 | 245 | 26.0 | 39.5 | 73.8 |
| | | Temperature 315° C. | | | |
| 10 | 613 | 675 | 30.0 | 62.0 | 57.2 |
| | 545 | 655 | 13.0 | 20.5 | 60.7 |

Additional materials having a matrix of aluminum mechanically alloyed to provide a composition containing 4% by weight magnesium and small amounts of carbon and oxygen was further processed to contain 10 and 20 volume percent $B_4C$. Elastic moduli at room temperature were estimated for these materials as 100 GPa for the material containing 10 volume percent $B_4C$ and 114 to 123 for the material containing 20 volume percent $B_4C$.

Composite powders consisting of said aluminum-copper-magnesium alloy have also been prepared by mechanically alloying pure metal powders for only 7½ hours in the Szegvari attritor size 100S, then adding silicon carbide grit (Norton Company) and continuing attrition for an additional ½ hour. This has considerably shortened the processing time and eliminated some processing steps such as removing the mechanically alloyed metallic powders, adding SiC to them and charging the mixture back into attritor. The composite powders thus produced have proved to be amenable to processing into useful shapes just as readily as the two-step process. It has been possible to extrude useful shapes at a temperature of 315° C. for a composite containing 20% SiC.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process for producing a composite product comprising a metallic matrix selected from the group of aluminum and aluminum-base alloys and particles of a hard reinforcing phase, to provide in the composite product at least one mechanical characteristic reflective of matrix metal properties and one mechanical characteristic reflective of said hard reinforcing phase properties comprising mechanically alloying particles of said aluminum or aluminum-base alloy in the absence of said hard reinforcing phase particles to at least about 50% of saturation hardness and thereafter mechanically milling the thus mechanically alloyed metal particles with particles of said hard reinforcing phase to provide a powder wherein said hard reinforcing phase particles comprise about 0.2% to about 30% by volume of said powder and wherein said reinforcing phase particles are enveloped in and bonded to said metallic matrix and thereafter pressing and heat processing said powder, alone or in admixture with other metal powder, to provide a mechanically formable, substantially void-free mass, said heat processing being conducted at a temperature appropriate to said metal matrix and at which said metal matrix is substantially entirely in the solid state.

2. A process as in claim 1 wherein said heat processing comprises vacuum hot pressing.

3. A process as in claim 2 wherein the hard reinforcing phase particles are hard particles from the group of carbides, borides, nitrides, oxides and intermetallic compounds.

4. A process as in claim 3 wherein said reinforcing phase particles are particles selected from the group of silicon carbide and boron carbide particles.

5. A process as in claim 1 wherein the mechanical alloying operation conducted to provide a mechanically alloyed matrix is conducted upon metal powder in the presence of a processing aid.

* * * * *